US006848772B2

(12) United States Patent
Kim

(10) Patent No.: US 6,848,772 B2
(45) Date of Patent: Feb. 1, 2005

(54) INK-JET PRINTHEAD AND METHOD OF MANUFACTURING THE SAME

(75) Inventor: Yun-gi Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/422,825

(22) Filed: Apr. 25, 2003

(65) Prior Publication Data

US 2003/0234833 A1 Dec. 25, 2003

(30) Foreign Application Priority Data

Jun. 20, 2002 (KR) ..... 10-2002-0034644

(51) Int. Cl.[7] ..... B41J 2/05
(52) U.S. Cl. ..... 347/63
(58) Field of Search ..... 347/63, 64, 56, 347/54, 20, 57, 58, 60, 69; 29/890.1; 216/7, 13, 27, 73

(56) References Cited

U.S. PATENT DOCUMENTS 5,883,650 A 3/1999 Figueredo et al.

*Primary Examiner*—Raquel Yvette Gordon
(74) *Attorney, Agent, or Firm*—Staas & Halsey LLP

(57) ABSTRACT

An ink-jet printhead and a method of manufacturing the ink-jet printhead include forming an insulating layer on a surface of a substrate, forming a metallic thin layer on the insulating layer, pattering the metallic thin layer through dry etching to form a plurality of pairs of conductors corresponding to a plurality of heaters to be formed in a subsequent operation, forming a resistant material layer on the substrate, patterning the resistant material layer through dry etching to form the heaters corresponding to the conductors, forming a nonconductive heat transfer layer on the substrate so as to cover the heaters and the conductors, forming a passage plate providing an ink chamber, in which each of the heaters are placed, on the substrate, and forming a nozzle plate having a nozzle corresponding to each ink chamber on the passage plate.

20 Claims, 6 Drawing Sheets

INK-JET PRINTHEAD AND METHOD OF MANUFACTURING THE SAME

CROSS-REFERENCE TO RELATED APPLICATIONS

This application claims the priority of Korean Patent Application No. 2002-34644, filed on Jun. 20, 2002, in the Korean Intellectual Property Office, the disclosure of which is incorporated herein in its entirety by reference.

BACKGROUND OF THE INVENTION

1. Field of the Invention

The present invention relates to an ink-jet printhead and a method of manufacturing the same, and more particularly, to an ink-jet printhead having an improved heater structure and a method of manufacturing the ink-jet printhead.

2. Description of the Related Art

Ink-jet printheads generate bubbles in ink using a heat source and eject ink droplets using a force generated by the bubbles.

FIG. 1 schematically illustrates a structure of a conventional ink-jet printhead disclosed in U.S. Pat. No. 5,883,650. Referring to FIG. 1, an insulating layer 2 is formed on a substrate 1, and a heater 3 is provided above the insulating layer 2. A pair of conductors 4 contact both lower sides of the heater 3. A passivation layer 5 and a cavitation barrier 6 are sequentially stacked on the heater 3. A passage plate 7 providing (defining) an ink chamber is formed on the cavitation barrier 6, and a nozzle plate 8, on which a nozzle 9 is formed, is placed on the passage plate 7.

The conductors 4 are formed of aluminum and are patterned through wet or dry etching. However, the heater 3, the passivation layer 5, and the cavitation barrier 6 are formed through physical vapor deposition (PVD) such as sputtering. Thus, isotropic etching using wet etching is essential for the patterning of the conductors 4. According to the PVD, material layers are not deposited onto a step perpendicular to a deposition plane, and thus stoppage in forming the heater 5 occurs because of defects of the heater 5 occurring in deposition of the material layers on the step of the conductors 4. Thus, in order to prevent this stoppage, a slope should exist on the step of the conductors 4 under the heater 3 as shown in FIG. 1, so that a material layer is well deposited onto the substrate 1 during a PVD process. The slope is formed on the step of the conductors 4 by wet etching. Thus, in the ink-jet printhead having the above structure shown in FIG. 1, the patterning of the conductors 4 should be dependent on wet etching. However, wet etching causes a profile of an etched part to be uneven and rough. The processing of wet etching reduces uniformity and reliability of the conductors 4. Meanwhile, if the heater 3 is formed through the PVD, a deviation in a thickness of the heater 3 becomes very large. Due to the deviation, even in the ink-jet printhead having a plurality of nozzles, an electrical resistance between heaters corresponding to each of the nozzles becomes non-uniform.

Meanwhile, as shown in FIG. 1, the heater 3 is not completely covered by the passivation layer 5 and the cavitation barrier 6, but an edge of the heater 3 is exposed. This allows the edge of the heater 3 to contact ink, thereby greatly reducing a life span of the heater 3.

SUMMARY OF THE INVENTION

The present invention provides an ink-jet printhead including a heater having an improved structure having uniform electrical characteristics and good durability, and a method of manufacturing the same.

The present invention also provides an ink-jet printhead having good reproductivity and high reliability and a method of manufacturing the same.

Additional aspects and advantages of the invention will be set forth in part in the description which follows and, in part, will be obvious from the description, or may be learned by practice of the invention.

According to an aspect of the present invention, an ink-jet printhead includes a substrate, a plurality of resistant heaters arranged on the substrate, a pair of conductors provided under corresponding one of the resistant heaters and electrically connected to the corresponding one of the resistant heaters to provide a current route passing through the resistant heaters, a nonconductive heat transfer layer formed on an entire surface of the substrate (the resistant heaters and the conductors) so as to cover corresponding ones of the resistant heaters and the conductors, a cavitation layer formed on the nonconductive heat transfer layer, a passage plate formed on portions of the nonconductive heat transfer layer and the cavitation layer to provide an ink chamber corresponding to the respective heaters, and a nozzle plate formed on the passage plate and including a nozzle corresponding to each ink chamber.

According to another aspect of the invention, the conductors and the heaters are formed through dry etching.

It is possible that the cavitation layer includes a first layer formed of one material selected from a group of W, TiN, TiAlN, and Ti and a second layer formed of Ta, and the heaters are formed of one material selected from a group of TaN, TiN, TiAlN, and WSiN. It is also possible that the conductors are formed of W, and in particular, adhering layers are provided on and under the conductors.

According to another aspect of the present invention, a method of manufacturing an ink-jet printhead includes forming an insulating layer on a surface of a substrate, forming a metallic thin layer on the insulating layer, pattering the metallic thin layer through dry etching to form a plurality of pairs of conductors having an opening corresponding to a plurality of heaters to be formed in a subsequent operation, forming a resistant material layer on a portion of the conductors and a portion of the substrate corresponding to the opening of the conductors to form the heaters on the substrate, patterning the resistant material layer through dry etching to form the heaters corresponding to the conductors, forming a nonconductive heat transfer layer on the substrate so as to cover the heaters and the conductors, forming a passage plate providing an ink chamber corresponding to each of the heaters, on the substrate, and forming a nozzle plate having a nozzle corresponding to the ink chamber on the passage plate.

According to another aspect to the invention, the heaters are formed of TaN, TiN, TiAlN, and WSiN. It is possible that in the forming of the conductors, the metallic thin layer is formed through chemical vapor deposition (CVD).

According to another aspect to the invention, in the forming of the heaters, the resistant material layer is formed through CVD.

It is also possible that the forming of the cavitation layer includes forming a first layer formed of W on the heat transfer layer and a second layer formed of Ta on the first layer.

According to another aspect of the present invention, an ink-jet printhead includes a substrate, a pair of conductors formed on a surface of the substrate and having a top surface and a step surface perpendicular to the surface of the substrate to define a hole through which a portion of the surface of the substrate is exposed, a heater formed on the portion of the substrate and the top and step surfaces of the conductors and having a bottom portion corresponding to the portion of the substrate, an upper portion formed on the top surface of the conductors, and a step sidewall formed on the step surface and disposed between the bottom and upper portions, a nonconductive heat transfer layer formed on the heater and a portion of the conductors, which is not covered by the heater, so as to cover the heater and the conductor, a cavitation layer formed on the nonconductive heat transfer layer, a passage plate formed on portions of the nonconductive heat transfer layer and the cavitation layer to provide an ink chamber corresponding to the heater, and a nozzle plate formed on the passage plate and having a nozzle corresponding to the ink chamber.

It is possible that that the step sidewall of the heater is formed on the step surface and disposed between the bottom and upper portions to be perpendicular to the bottom portion to correspond to a thickness of the side of the conductors.

It is possible that the conductors include first end and second ends having first and second areas to be coupled to the heater, respectively, and the sectional area of the heater is enlarged in a direction from the first end of the first conductor to the second end of the second conductor.

According to another aspect of the present invention, a method in an ink-jet printhead includes forming a pair of conductors on a surface of a substrate, the conductors having a top surface and a step surface disposed between the surface of the substrate and the top surface to be perpendicular to the surface of the substrate to define a hole through which a portion of the surface of the substrate is exposed, forming a heater on the portion of the substrate and the top and step surfaces of the conductors, the heater having a bottom portion corresponding to the portion of the substrate, an upper portion formed on the top surface of the conductors, and a step sidewall formed on the step surface and disposed between the bottom and upper portions, forming a nonconductive heat transfer layer on the heater and a portion of the conductors, which is not covered by the heater, so as to cover the heater and the conductor, forming a cavitation layer on the nonconductive heat transfer layer, forming a passage plate on portions of the nonconductive heat transfer layer and the cavitation layer to provide an ink chamber corresponding to the heater, and forming a nozzle plate on the passage plate and having a nozzle corresponding to the ink chamber.

It is possible that the step sidewall of the heater is formed on the step surface and disposed between the bottom and upper portions to be perpendicular to the bottom portion to correspond to a thickness of the side of the conductors.

It is possible that the conductors includes first end and second ends having first and second areas to be coupled to the heater, respectively, and the sectional area of the heater is enlarged in a direction from the first end of the first conductor to the second end of the second conductor.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Hereinafter, the present invention will be described in detail by describing preferred embodiments of the invention with reference to the accompanying drawings. An ink-jet printhead according to the present invention has a structure in which a plurality of unit ink-jet portions each including one heater and an ink chamber nozzle corresponding to the heater are aligned in one substrate. However, in the following descriptions, in order to avoid complexity, only one ink-jet portion will be described.

Figure 1:
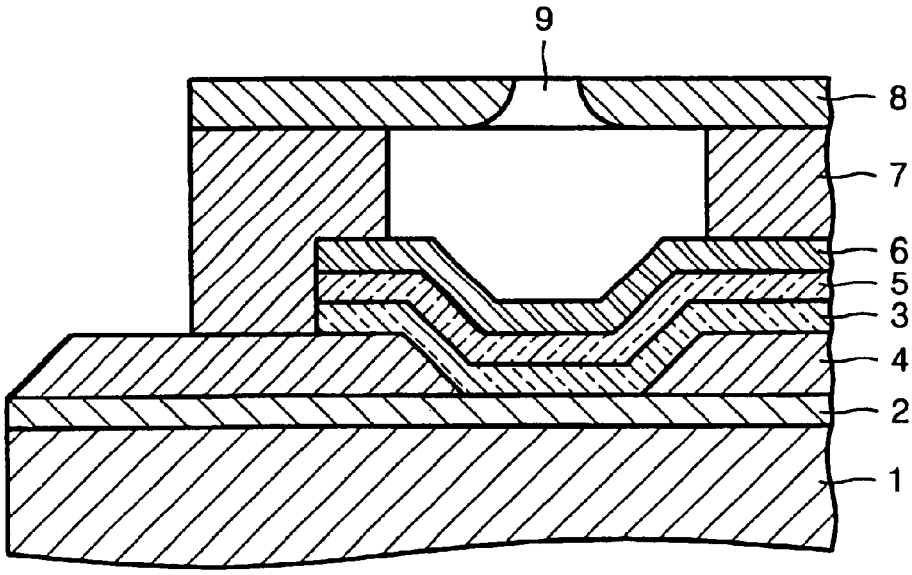
FIG. 1 (PRIOR ART)
FIG. 1 schematically illustrates a structure of a conventional ink-jet printhead.
Figure 2:
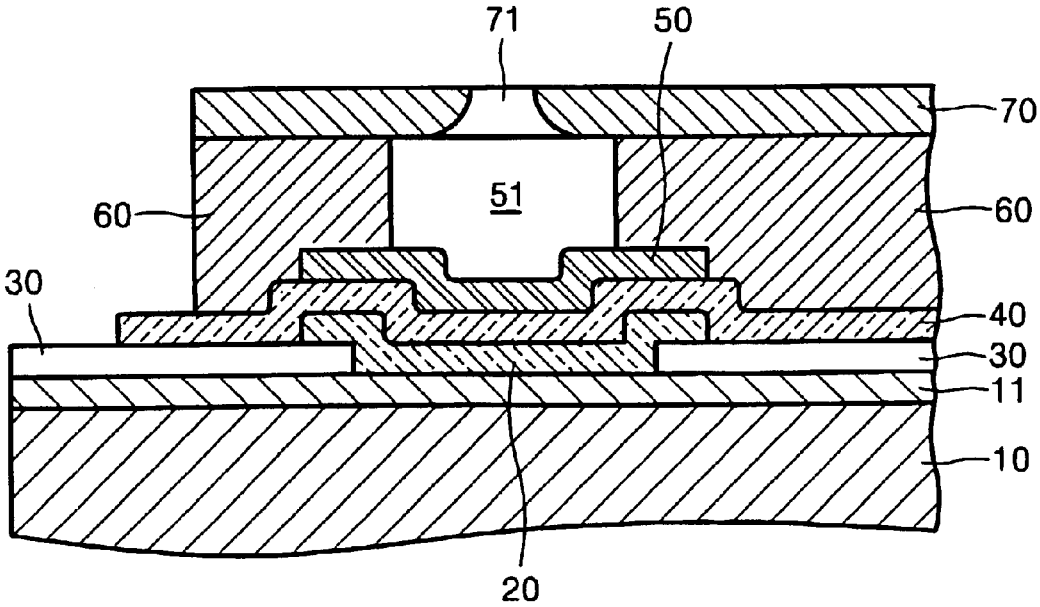
FIG. 2 is a partial cross-sectional view of an ink-jet printhead according to an embodiment of the present invention.

FIG. 2 is a partial cross-sectional view of an ink-jet printhead according to an embodiment of the present invention. Referring to FIG. 2, an insulating layer 11 formed of silicon oxide is formed on a surface of a substrate 10, and a heater 20 formed of one of TaN, TiN, TiAlN, and WSiN is formed on the insulating layer 11. A pair of conductors 30 formed of Al or W provide a current route to the heater 20 and are provided at both lower sides of the heater 20. A heat transfer layer 40 formed of SiN or undoped polysilicon having an electrical insulation property through sputtering or chemical vapor deposition (CVD) is provided on the heater 20. The heat transfer layer 40 serves as a passivation layer and is formed on an entire surface of the substrate 10 (the heater 20 and the conductors 30) so as to cover the heater 20 and the conductors 30. Meanwhile, a cavitation layer 50, which is formed of W, TiN, TiAlN, or Ti and is placed directly above the heater 20, is provided on the heat transfer layer 40. The cavitation layer 50 is placed on a bottom of an ink chamber 61, which will be described later. A passage plate 60 providing the ink chamber 61 and an ink passage (not shown) connected to the ink chamber 61 is formed on the cavitation layer 50. A nozzle plate 70 having a nozzle 71 placed above the ink chamber 61 is formed on the passage plate 60. Although the heater 20 and the pair of the conductors 30 are described in FIG. 2, a plurality of heaters and a plurality of pairs of conductors corresponding to the respective heaters may be formed on the surface of the substrate 10.

In the above structure, the heater 20 is completely covered by the heat transfer layer 40 and is protected, unlike in a conventional ink-jet printhead. The heat transfer layer 40 electrically protects the heater 20 and prevents ink from contacting the heater 20. Also, surplus heat generated by the heater 20 is eliminated through the heat transfer layer 40, thereby preventing thermal accumulation in the vicinity of the heater 20. The cavitation layer 50 protects the heat transfer layer 40 and the heater 20 from a physical shock caused by a rapid contraction of bubbles after ink droplets are ejected through the nozzle 71.

In the above structure, each of at least one of the conductors, the heater, and the cavitation layer has a multi-layer structure other than the above-mentioned structure. Here, the multi-layer structure may be formed of the same material or different materials. Another ink-jet printhead adopting the multi-layer structure according to another embodiment of the presenting invention is shown in FIG. 3.

Figure 3:
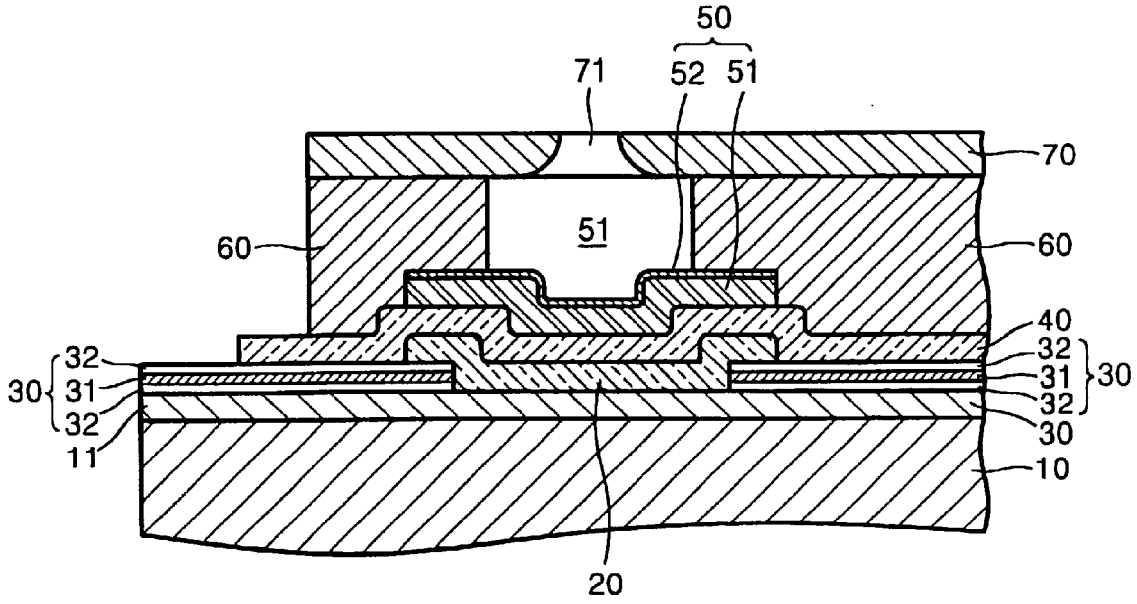
FIG. 3 is a partial cross-sectional view of an ink-jet printhead according to another embodiment of the present invention.

Referring to FIG. 3, the cavitation layer 50 includes a first layer 51 formed of one of W, TiN, TiAlN, and Ti, and a second layer 52 formed of Ta on a surface of the first layer 51. The conductors 30 include an intermediate layer 31 formed of Al in a middle of the conductors 30, and two conductive adhering layers 32 formed of one of polysilicon, Ti, TiN, and TaN on and under the intermediate layer 31, respectively. This multi-layer structure prevents defects, which prevent the heater 20 from adhering to the substrate 10, caused by high-temperature during the CVD of the heater 20.

Figure 4:
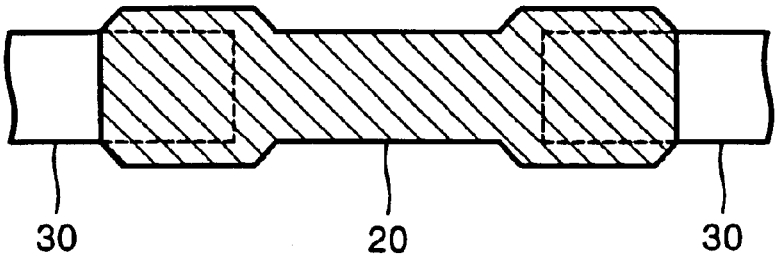
FIGS. 4 and 5 are plane views respectively illustrating a relation between a heater and conductors adopted in the ink-jet printhead shown in FIGS. 2 and 3.
Figure 5:
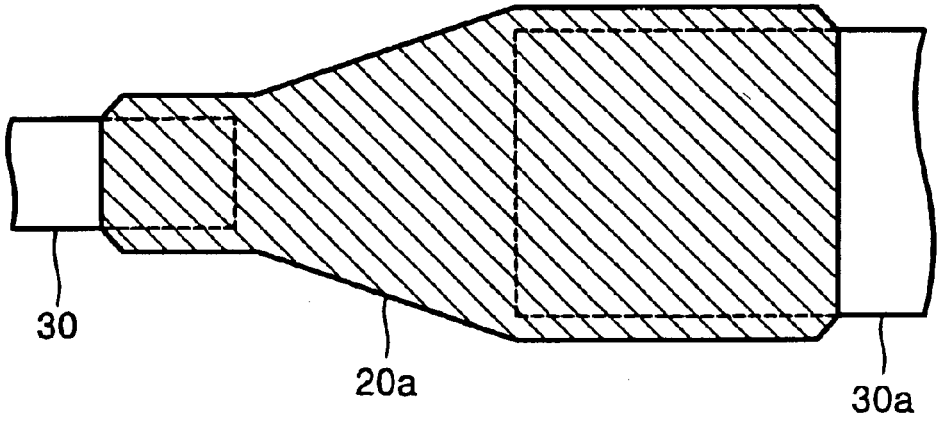

FIGS. 4 and 5 are plane views respectively illustrating a relation between the heater 20 and the conductors 30 adopted in the ink-jet printhead shown in FIGS. 2 and 3. In FIG. 4, the heater 20 has a symmetrical structure, and both ends of the heater 20 are connected to respective ones of the conductors 30 by overlapping the ends of the heaters 20 and the respective ones of the conductors 30. In FIG. 5, the heater 20 is formed in an asymmetrical shape such that a sectional area 20*a* of the heater 20 is increased in a progressive direction of ink current. Accordingly, the two conductors 30 have different sectional areas.

Hereinafter, a method of manufacturing the ink-jet printhead shown in FIGS. 2 and 3 will be described in detail with reference to the attached drawings. A plurality of ink-jet printheads are manufactured in consecutive processes on one wafer. For convenience sake, the following will be described on a basis of the above-mentioned unit ink-jet portions, e.g., one of the ink-jet printheads.

Figure 6A:
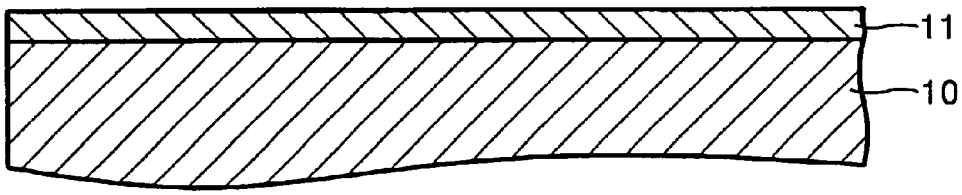
FIGS. 6A through 6I illustrate a method of manufacturing the ink-jet printhead shown in FIGS. 2 and 3.

The surface of the substrate 10 made of silicon is heated at a high temperature, thereby forming the insulating layer 11 of silicon oxide to a thickness of 1–3 $\mu$m as shown in FIG. 6A.

Figure 6B:
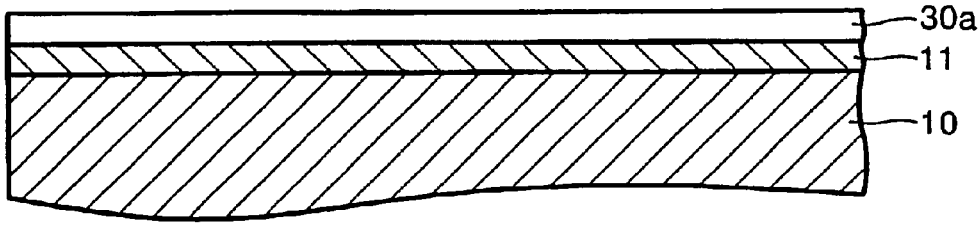

A metal layer 30*a* is formed on the insulation layer 11 to form the conductors as shown in FIG. 6B. The metal layer 30*a* is formed of Al or tungsten to a thickness of 5000 Å-2 $\mu$m through one of the CVD and physical vapor deposition (PVD).

Figure 6C:
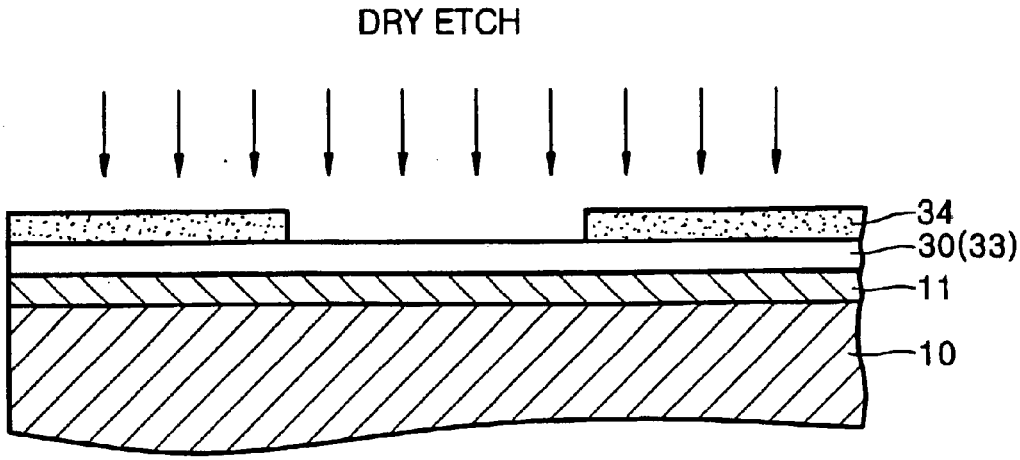

A mask 34 formed of photoresist is formed in a metal interconnection pattern shape and disposed on or above a surface of the metal layer 30*a* through photolithography as shown in FIG. 6C.

Figure 6D:
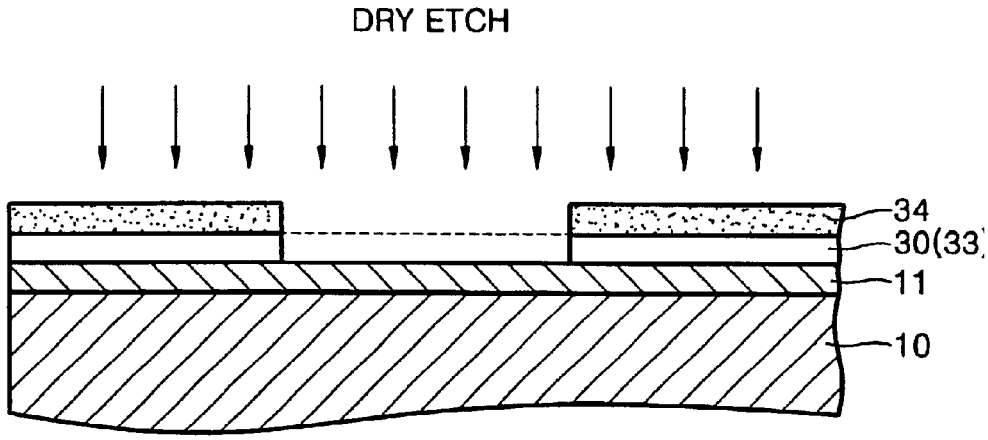

Metals existing in a portion of the metal layer 30*a* not covered by the mask 34 are removed through dry etching, thereby forming the conductors 30 as shown in FIG. 6D. After etching is completed, the mask 34 is removed through $O_2$ plasma ashing and stripping processes, which are typical processes of removing the photoresist.

Figure 6E:
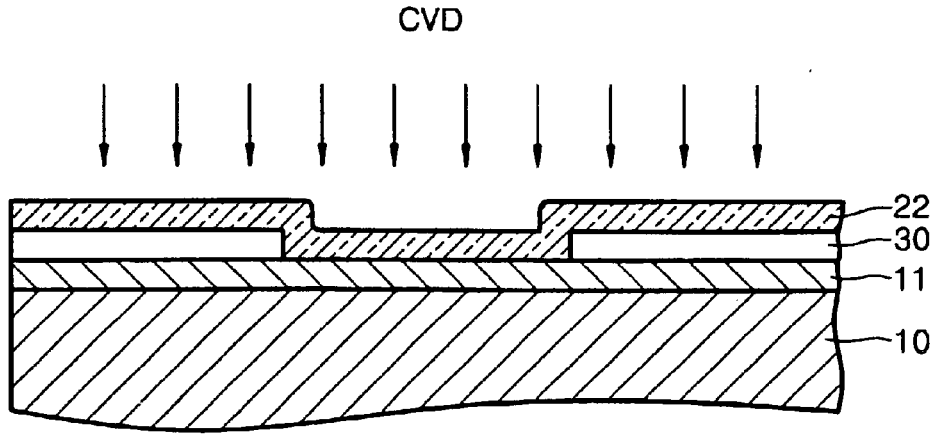

A heater material layer 22 is formed on entire top surfaces of the conductors 30 and the insulating layer 11 that is not covered by the conductors 30, through chemical vapor deposition (CVD) as shown in FIG. 6E. TaN, TiN, TiAlN, or WSiN is used as a heater material of the heater material layer 22.

Figure 6F:
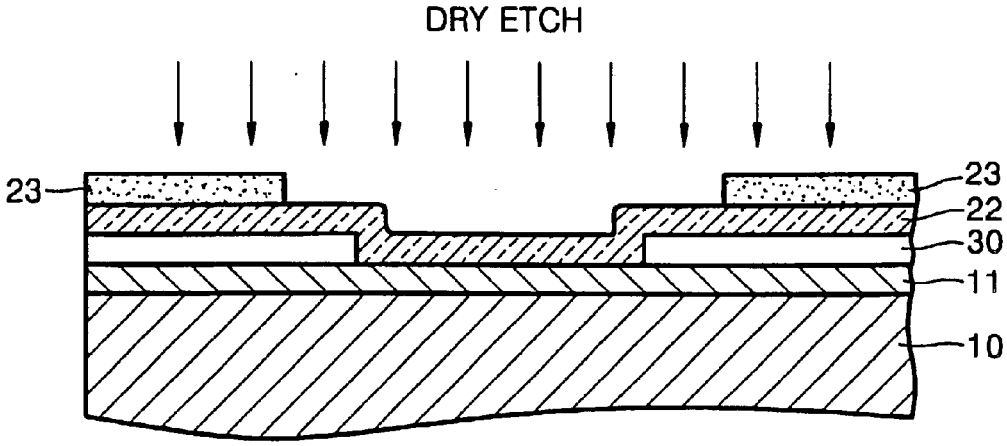
Figure 6G:
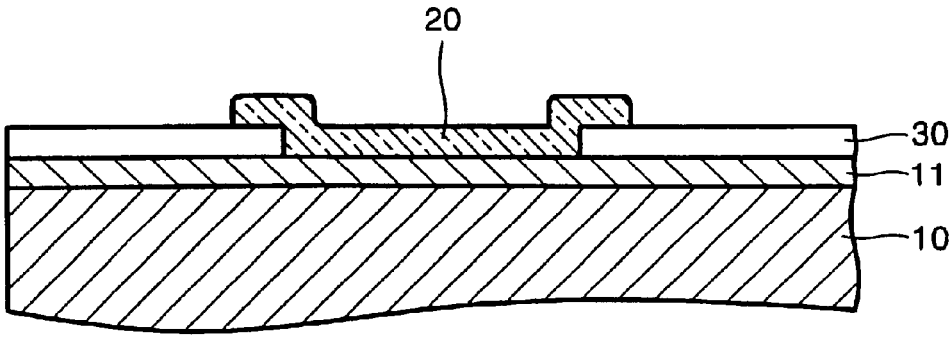

As shown in FIG. 6F, a mask layer 23 having an opening of a desired pattern is formed on the heater material layer 22, and then, a heater 20 shown in FIG. 6G is obtained from the heater material layer 22 by performing a dry etching process of an exposed portion of the heater material layer 22 corresponding to the mask layer 23.

Figure 6H:
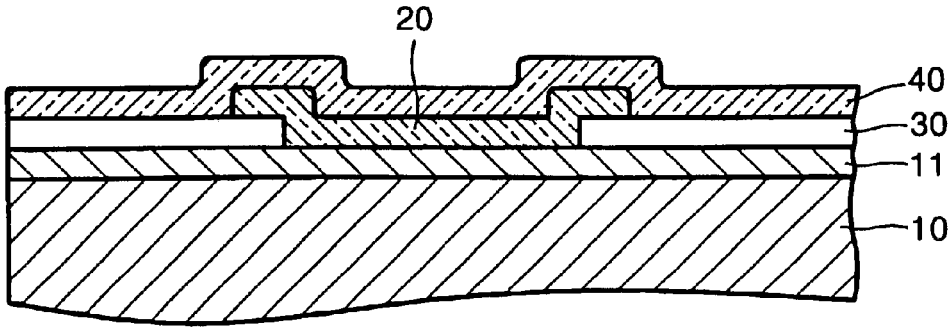

A nonconductive material of SiN or polysilicon is formed on an uppermost surface of a stacked resultant of an operation of FIG. 6G through sputtering or CVD to form the heat transfer layer 40 as shown in FIG. 6H.

Figure 6I:
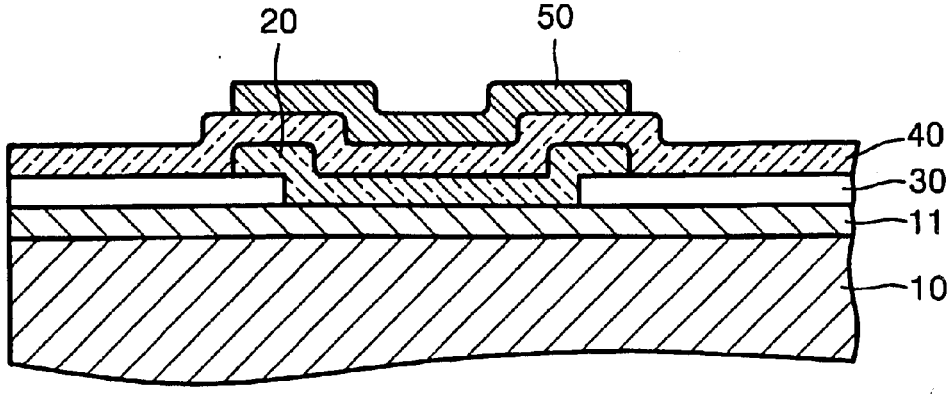

Ta or W is deposited onto a top surface of the nonconductive heat transfer layer 40, and is then patterned so that only a portion of the Ta or W corresponding to an upper portion of the heater 20 remains, thereby forming a cavitation layer 50 as shown in FIG. 6I.

Next, the passage plate 60 is formed through well-known coating of polyimide and pattering thereof, and finally, the nozzle plate 70 is formed on the passage plate 60, thereby obtaining the ink-jet printhead having the structure of FIG. 2.

In the method of manufacturing the ink-jet printhead, the conductors 30 are dry etched, the heater material is deposited onto the conductors 30 to be electrically connected to the conductors 30, and then the mask 34 is formed, and the heater material is patterned through dry etching, thereby forming the heater 20. Dry etching of the conductors 30 and the heater 20 is advantageous to a fine pattern. In particular, when the conductors and heaters are provided on the substrate, e.g., a single substrate or a single wafer, the conductors and the heaters have uniform patterns and electrical characteristics.

The present invention adopts dry etching, not wet etching, so as to prevent non-uniformity of physical and electrical characteristics between the heaters and the conductors formed on the substrate. It is possible that the conductors are formed of a material, which is tungsten rather than Al, strong enough to resist a thermal shock in a subsequent process. In addition, the heater material is formed through the high-temperature chemical vapor deposition (CVD) other than the physical vapor deposition (PVD), such as sputtering, such that the heater material has a good process margin. The heat transfer layer 40 of SiN is formed on the heat material as a passivation layer through the high-temperature CVD, thereby increasing a hardness of the heater 20 and further increasing reliability of the ink-jet printhead.

As described above, the ink-jet printhead according to the embodiments of the present invention has a structure in which the heater is safely protected from ink. In particular, the heat transfer layer protecting the heater has a thermal emission capability to effectively prevent thermal accumulation in the vicinity of the heater. Because of the effective thermal emission structure, the performance of the ink-jet printhead is improved, and in particular, a response speed of the ink-jet printhead is improved, such that the ink-jet printhead operates at a higher frequency.

In addition, since dry etching is adopted in the method of manufacturing the ink-jet printhead according to the present invention, the conductors and the heater have uniform electrical characteristics.

While this invention has been particularly shown and described with reference to preferred embodiments thereof, it will be understood by those skilled in the art that various changes in form and details may be made therein without departing from the spirit and scope of the invention as defined by the appended claims and their equivalents.

What is claimed is:

1. An ink-jet printhead comprising:

a substrate;

a plurality of resistant heaters arranged on the substrate;

a pair of conductors provided under a corresponding one of the heaters and electrically connected to the corresponding one of the heaters to provide a current route passing through the heaters;

a nonconductive heat transfer layer formed on the heaters and the conductors so as to cover the heaters and the conductors;

a cavitation layer formed on the nonconductive heat transfer layer;

a passage plate formed on portions of the nonconductive heat transfer layer and the cavitation layer to provide an ink chamber disposed to correspond to each of the heaters; and a nozzle plate formed on the passage plate and having a nozzle corresponding to each ink chamber.

2. The printhead of claim 1, wherein the conductors and the heaters are formed through dry etching.

3. The printhead of claim 1, wherein the cavitation layer comprises:

a first layer formed of one material selected from a group of W, TiN, TiAlN, and Ti; and a second layer formed of Ta.

4. The printhead of claim 1, wherein the heaters comprise:

one material selected from a group of TaN, TiN, TiAlN, and WSiN.

5. The printhead of claim 1, wherein the conductors comprise:

a conductive material of W.

6. The printhead of claim 1, wherein the conductors comprise:

adhering layers provided on and under the conductors.

7. A method of manufacturing an ink-jet printhead, the method comprising:

forming an insulating layer on a surface of a substrate;

forming a metallic thin layer on the insulating layer;

patterning the metallic thin layer through dry etching to form a plurality of pairs of conductors having an opening;

forming a resistant material layer on a portion of the conductors and a portion of the substrate corresponding to the opening of the conductors;

patterning the resistant material layer through dry etching to form a plurality of heaters corresponding to the conductors;

forming a nonconductive heat transfer layer on the heaters and the conductors so as to cover the heaters and the conductors;

forming a cavitation layer on the nonconductive heat transfer layer;

forming a passage plate on portions of the cavitation layer and the nonconductive heat transfer layer to provide an ink chamber, in which each of the heaters is placed; and forming a nozzle plate having a nozzle corresponding to the ink chamber on the passage plate.

8. The method of claim 7, wherein the heaters are formed of one of TaN, TiN, TiAlN, and WSiN.

9. The method of claim 7, wherein the forming of the conductors comprises:

forming the metallic thin layer through chemical vapor deposition (CVD).

10. The method of claim 7, wherein the forming of the heaters comprises:

forming the resistant material layer through chemical vapor deposition (CVD).

11. The method of claim 7, wherein the forming of the cavitation layer comprises:

forming a first layer formed of W on the nonconductive heat transfer layer; and forming a second layer formed of Ta on the first layer.

12. An ink-jet printhead comprising:

a substrate;

a pair of conductors formed on a surface of the substrate, and having a top surface and a step surface perpendicular to the surface of the substrate to define a hole through which a portion of the surface of the substrate is exposed;

a heater formed on the portion of the substrate and the top and step surfaces of the conductors, and having a bottom portion corresponding to the portion of the substrate, an upper portion formed on the top surface of the conductors, and a step sidewall formed on the step surface and disposed between the bottom and upper portions;

a nonconductive heat transfer layer formed on the heater and a portion of the conductors, which is not covered by the heater, so as to cover the heater and the conductor;

a cavitation layer formed on the nonconductive heat transfer layer;

a passage plate formed on portions of the nonconductive heat transfer layer and the cavitation layer to provide an ink chamber corresponding to the heater; and a nozzle plate formed on the passage plate and having a nozzle corresponding to the ink chamber.

13. The printhead of claim 12, wherein the conductors have the same thickness as a height of the step surface.

14. The printhead of claim 12, wherein the step sidewall of the heater is perpendicular to one of the bottom portion and the upper portion.

15. The printhead of claim 12, wherein the step sidewall of the heater has a uniform thickness and is perpendicular to the surface of the substrate.

16. The printhead of claim 12, wherein the hole defined by the conductors has a first area in a direction parallel to the surface of the substrate, and the ink chamber has a second area smaller than the first area in the direction parallel to the surface of the substrate.

17. The printhead of claim 12, wherein the heater has a first area in a direction parallel to the surface of the substrate, and the nonconductive heat transfer layer has a second area larger than the first area of the heater in the direction parallel to the surface of the substrate.

18. The printhead of claim 12, wherein the nonconductive heat transfer layer has an area larger than that of the heater and the cavitation layer in a direction parallel to the surface of the substrate.

19. The printhead of claim 12, wherein the nonconductive heat transfer layer and cavitation layer each comprise:

a second step portion corresponding to the step surface of the conductors to be perpendicular to the surface of the substrate.

20. The printhead of claim 12, wherein the upper portion of the heater comprises an outer sidewall defining an outer peripheral circumferential surface of the heater, and the nonconductive heat transfer layer is formed on the bottom and upper portion, the step sidewall, and the outer sidewall of the heater and the portion of the conductors portion which is not covered by the heater.

* * * * *

UNITED STATES PATENT AND TRADEMARK OFFICE

CERTIFICATE OF CORRECTION

PATENT NO. : 6,848,772 B2
DATED : February 1, 2005
INVENTOR(S) : Yun-gi Kim

It is certified that error appears in the above-identified patent and that said Letters Patent is hereby corrected as shown below:

Title page,
Item [57], ABSTRACT,
Line 4, change "pattering" to -- patterning --.

Signed and Sealed this

Sixth Day of December, 2005

JON W. DUDAS
*Director of the United States Patent and Trademark Office*